US007763164B1

(12) United States Patent
Turner et al.

(10) Patent No.: US 7,763,164 B1
(45) Date of Patent: Jul. 27, 2010

(54) GASOLINE SULFUR REDUCTION IN FCCU CRACKING

(75) Inventors: William Jay Turner, Seabrook, TX (US); Ronald Lee Cordle, Raceland, KY (US); David J. Zalewski, Proctorville, OH (US); Jeffrey A. Sexton, Findlay, OH (US)

(73) Assignee: Marathon Petroleum Company LLC, Findlay, OH (US)

( * ) Notice: Subject to any disclaimer, the term of this patent is extended or adjusted under 35 U.S.C. 154(b) by 382 days.

(21) Appl. No.: 11/799,976

(22) Filed: May 3, 2007

Related U.S. Application Data

(60) Provisional application No. 60/798,267, filed on May 4, 2006.

(51) Int. Cl.
*C10G 29/00* (2006.01)
*C10G 45/00* (2006.01)
*C07C 5/00* (2006.01)

(52) U.S. Cl. ..... 208/243; 208/89; 208/143; 208/208 R; 208/216 PP; 208/244; 585/250; 585/258; 585/259; 585/260; 585/266; 585/269; 585/270; 585/272; 585/273; 585/274; 585/275; 585/276; 585/277; 502/64; 502/66; 502/67; 502/211

(58) Field of Classification Search ..... 208/89, 208/143, 216 PP, 208 R, 244, 243, 120.3, 208/120.35, 120.15, 121, 123, 124; 585/250, 585/258, 259, 260, 266, 269, 270, 272, 273, 585/274–277; 502/64, 66, 67, 211
See application file for complete search history.

(56) References Cited

U.S. PATENT DOCUMENTS 4,426,276 A * 1/1984 Dean et al. ..... 208/60
4,450,241 A * 5/1984 Hettinger et al. ..... 502/34
4,672,048 A * 6/1987 Ward ..... 502/66
4,915,820 A 4/1990 Hettinger, Jr.
4,976,847 A * 12/1990 Maxwell et al. ..... 208/120.15
5,378,352 A * 1/1995 Degnan et al. ..... 208/217
5,451,313 A 9/1995 Wegerer et al.
5,527,979 A * 6/1996 Agaskar et al. ..... 585/659
5,530,171 A * 6/1996 Agaskar et al. ..... 585/659
5,685,973 A * 11/1997 Zones et al. ..... 208/120.1
5,871,635 A * 2/1999 Gupta et al. ..... 208/89
6,042,719 A * 3/2000 Shih ..... 208/217
6,368,495 B1 4/2002 Kocal et al.
6,482,315 B1 * 11/2002 Roberie et al. ..... 208/249
6,676,830 B1 1/2004 Vichailak et al.
6,746,598 B1 * 6/2004 Zanibelli et al. ..... 208/209
6,923,903 B2 8/2005 Chester et al.
7,056,482 B2 6/2006 Hakka et al.
7,125,817 B2 * 10/2006 Ou et al. ..... 502/64
7,288,181 B2 * 10/2007 Shih et al. ..... 208/89
2003/0089639 A1 * 5/2003 Chester et al. ..... 208/120.01
2003/0181325 A1 * 9/2003 Ou et al. ..... 502/302
2004/0092385 A1 * 5/2004 Timken ..... 502/64
2004/0167013 A1 * 8/2004 Ou et al. ..... 502/64
2005/0205467 A1 9/2005 Hedrick et al.

* cited by examiner

*Primary Examiner*—Walter D Griffin
*Assistant Examiner*—Huy-Tram Nguyen
(74) *Attorney, Agent, or Firm*—Emch, Schaffer, Schaub & Porcello Co., L.P.A.

(57) ABSTRACT

This invention focuses on the specialized catalyst and/or additive for lower FCCU gasoline and diesel blendstock component sulfur content. This invention utilizes a specified ratio of the transition metal oxides of cobalt and molybdenum to accomplish gasoline and diesel blendstock sulfur reduction. This is accomplished by minimizing sulfur compound formation in the FCCU riser. The cobalt and molybdenum oxides in the presence of $H_2S$ from cracked organic sulfur compounds are converted to metal sulfides. A portion of the overall sulfur reduction in the gasoline and diesel blendstock occurs emitted $NO_x$ also is reduced.

22 Claims, 15 Drawing Sheets
(14 of 15 Drawing Sheet(s) Filed in Color)

GASOLINE SULFUR REDUCTION IN FCCU CRACKING

CROSS REFERENCE TO RELATED APPLICATION

This application is a conversion of and claims the benefit of U.S. provisional patent application Ser. No. 60/798,267 filed May 4, 2006.

TECHNICAL FIELD

This invention relates to the reduction of sulfur in gasoline and other petroleum products produced by a catalytic cracking process. The invention uses a specific FCCU catalyst additive. This invention relates to a novel approach to FCCU gasoline sulfur reduction. The approach uses a specified ratio of the transition metal oxides of cobalt and molybdenum to accomplish gasoline and diesel blendstock sulfur reduction. This approach also reduces emitted $NO_x$.

BACKGROUND OF THE INVENTION

Catalytic cracking is a petroleum refining process which is applied commercially on a very large scale. A majority of the refinery gasoline blending pool in the United States is produced by this process. In the catalytic cracking process heavy hydrocarbon fractions are converted into lighter products by reactions taking place at elevated temperature in the presence of a catalyst, with the majority of the conversion or cracking occurring in the vapor phase. The feedstock is thereby converted into gasoline, distillate and other liquid cracking products as well as lighter gaseous cracking products.

During catalytic cracking, heavy material, known as coke, is deposited onto the catalyst. This reduces its catalytic activity and regeneration is desired. After removal of hydrocarbons from the spent cracking catalyst, regeneration is accomplished by burning off the coke which restores the catalyst activity. The three characteristic steps of the catalytic cracking can be therefore be distinguished: a cracking step in which the hydrocarbons are converted into lighter products, a stripping step to remove hydrocarbons adsorbed on the catalyst and a regeneration step to burn off coke from the catalyst. The regenerated catalyst is then reused in the cracking step. Catalytic cracking feedstocks normally contain sulfur in the form of organic sulfur compounds such as mercaptans, sulfides and thiophenes. The products of the cracking process correspondingly tend to contain sulfur impurities even though about half of the sulfur is converted to hydrogen sulfide during the cracking process.

For modern refineries, the Fluid Catalytic Cracking Unit (FCCU) produces 40 to 60+% of the gasoline in the gasoline pool. In addition, the FCCU produces a blendstock component for diesel manufacture. Air quality regulations for these transportation fuels will require a further reduction in sulfur content as mandated by the Clean Air Act. For the FCCU process, there are two routes a refiner can utilize to further reduce the sulfur content of these transportation fuels. The first route is via a hydrotreatment process on the feedstock to the FCCU. This hydrotreatment process can by operational severity and design, remove a substantial amount of the feed sulfur to produce a gasoline sulfur content of 100 ppmw or less. The second route a refiner can take involves the use of a specialized catalyst or additive in the FCCU circulating catalyst inventory that can catalytically remove sulfur from the FCCU product distributions. Refiners may elect to use this route for both non-hydrotreated and/or hydrotreated FCCU feedstock derived from various crude sources. In addition, if a refiner utilizes the first route for desired gasoline sulfur content, when the hydrotreater is taken out of service for an outage, this specialized catalyst or additive can be utilized to minimize the increase of gasoline sulfur during the outage period.

A need exists to continue to remove $SO_2$ gas. A need also remains in the refining industry for improved compositions and processes which minimizes the content of gas phase reduced nitrogen species and $NO_x$ emitted from a partial or complete combustion FCCU riser during an FCC process, which compositions are effective and simple to use.

Other objects and advantages of the present invention will become apparent to those skilled in the art upon a review of the following detailed description of the preferred embodiments and the accompanying drawings.

SUMMARY OF THE INVENTION

We have now found catalytic materials for use in the catalytic cracking process which are capable of improving the reduction in the sulfur content of the liquid products of the cracking process including, in particular, the gasoline and middle distillate cracking fractions. The present sulfur reduction catalysts may be used in the form of an additive catalyst in combination with the active cracking catalyst in the cracking unit, that is, in combination with the conventional major component of the circulating cracking catalyst inventory.

This invention focuses on the specialized catalyst additive for lower FCCU gasoline and diesel blendstock sulfur reduction. Compared to commercially available catalysts and additives, this invention offers the following benefits over current commercial offerings at a constant wt %. The improvements are: a significant improvement in gasoline sulfur reductions, a significant reduction in diesel blendstock component sulfur content, a significant reduction in thiophenic, benzothiophenic and di-benzothiophenic compounds, a significant increase in propylene, a significant increase in iso-butylenes, a significant increase in total pentenes with a corresponding increase in amylenes and iso-amylenes, a significant reduction in ethane, propane and butane, a significant reduction of organic sulfur compounds in the Liquefied Petroleum Gas (LPG) an increase in FCC gasoline (R+M/2) octane, a significant reduction of H2S and a reduction in flue gas NOx.

This is accomplished by; minimizing sulfur compound formation in the FCCU riser. The cobalt and molybdenum oxides in the presence of H2S from cracked organic sulfur compounds are converted to metal sulfides. A portion of the overall sulfur reduction in the gasoline and diesel blendstock occurs by minimizing the availability of H2S to combine with olefinic compounds formed in the cracking reactions. It further is accomplished by maximizing the amount of refractory sulfur left uncracked in the slurry oil while maintaining a specified slurry oil production target. As slurry oil refractory sulfur is reduced via cracking, the various lighter cracked sulfur compounds formed are distributed or cracked "upwards" into the diesel blendstock, gasoline and LPG range products.

While this specification is described in terms of cobalt and molybdenum oxides, the invention comprises a mixture of particulate metal oxides of Group VIB metal oxides and Group VIII metal oxides.

In the preferred embodiment, the mixture of particulate metal oxides is pulverized particulate. In another embodiment, a conventional cracking catalyst is impregnated with the additive mixture.

BRIEF DESCRIPTION OF THE DRAWINGS

The file of this patent contains at least one drawing executed in color. Copies of this patent with color drawing(s) will be provided by the Patent and Trademark Office upon request and payment of necessary fee.

DETAILED DESCRIPTION OF THE INVENTION

Figure 1:
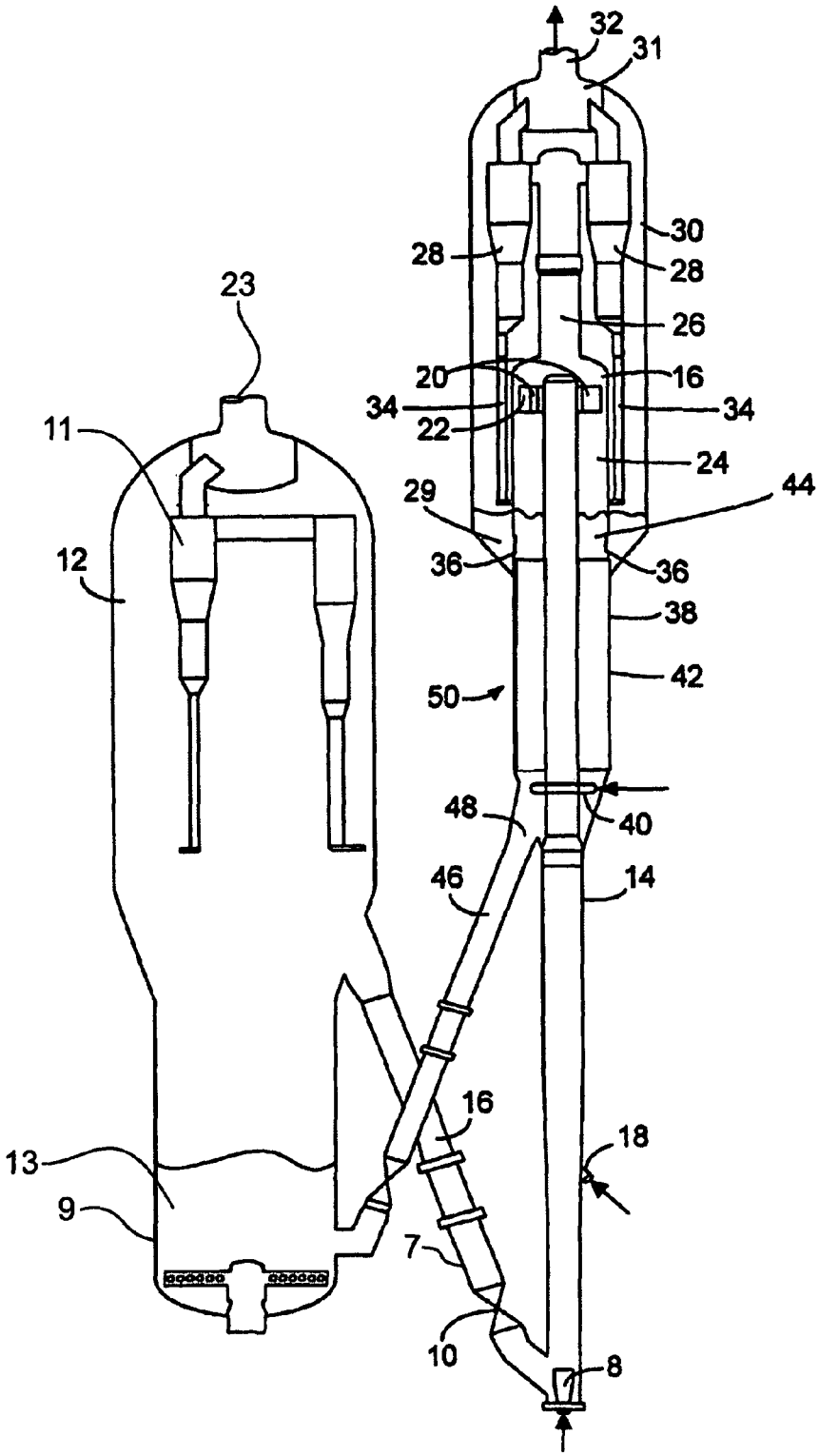
FIG. 1 is a schematic diagram of an FCCU unit comprising a reactor and a riser showing the catalyst system of the present invention in place for the operating that FCCU unit.

The present additives are used as a component of the circulating inventory of catalyst in the catalytic cracking process referred to as an FCCU process. Briefly, the FCCU process in which the heavy hydrocarbon feed containing the organosulfur compounds will be cracked to lighter products takes place by contact of the feed in a cyclic catalyst recirculation cracking process with a circulating fluidizable catalytic cracking catalyst inventory. The significant steps in the cyclic process are: (i) the feed is catalytically cracked in a catalytic cracking zone, normally a riser cracking zone, operating at catalytic cracking conditions by contacting feed with a source of hot, regenerated cracking catalyst to produce an effluent comprising cracked products and spent catalyst containing coke and strippable hydrocarbons; (ii) the effluent is discharged and separated, normally in one or more cyclones, into a vapor phase rich in cracked product and a solids rich phase comprising the spent catalyst; (iii) the vapor phase is removed as product and fractionated in the FCC main column and may be associated side columns to form liquid cracking products including gasoline; (iv) the spent catalyst is stripped, usually with steam, to remove occluded hydrocarbons from the catalyst, after which the stripped catalyst is oxidatively regenerated to produce hot, regenerated catalyst which is then recycled to the cracking zone for cracking further quantities of feed.

Slurry oil can be combined and fed to a fluid catalytic cracking unit (FCCU) to crack the hydrocarbons contained therein to smaller chained hydrocarbons, especially gasoline boiling range and heating oil. Hydrotreating prior to cracking is considered beneficial in gasoline. The gasoline is improved and a considerable amount of the sulfur will be removed which reduces $SO_2$ emissions from FCCU itself.

The organic sulfur compounds are almost always considered to be contaminants. They hinder in downstream processing and at the very least make obnoxious SO2 gas when burned. For these reasons it is very desirable to remove these compounds. The degree of removal is dependent upon the use of the fraction. For instance, feed streams to catalytic reforming require extremely low sulfur concentrations.

The particulate additive of this invention is used in combination with an active catalytic cracking catalyst. Normally this is a faujasite such as zeolite Y and REY. Zeolite USY and REUSY also are known to process hydrocarbon feedstocks in the FCC unit to produce low-sulfur products.

The additive of this invention comprises a mixture of particulate metal oxides of Group VIB metal oxides and Group VIII metal oxides. The mixture of particulate metal oxides further comprises 5 to 30 wt. % of Group VIB metal oxides and 2 to 10 wt % of a Group VIII metal oxides. Preferably, the mixture of particulate metal oxides is pulverized particulate. Another embodiment of this invention further comprises the step of impregnating the cracking catalyst with the additive prior to catalytically cracking the petroleum feed fraction.

Preferably the Group VIB metal oxide is molybdenum oxide and the Group VIII metal oxide cobalt oxide. Preferably, the additive contains 5 to 20 wt. % of the Group VIB metal oxide and 2 to 5 wt. % of the Group VIII metal oxide.

Generally, the additive is present in an amount ranging from 1 to 25 weight percent of the weight of the cracking catalyst. Preferably, the additive is present in an amount ranging from 5 to 25 weight percent of the weight of the cracking catalyst. More preferably, the additive is present in an amount ranging from 10 to 25 weight percent of the weight of the cracking catalyst.

Generally, the additive has a particle size ranging from 1 nm to 900 nm. Preferably the additive has a particle sizing ranging from 50 nm to 800 nm. More preferably, the additive has a particle size ranging from 100 nm to 700 nm.

FIG. 1 is a schematic diagram of a typical FCC unit showing a regenerator, separator and stripper. FIG. 1 shows an FCC unit, comprising standpipe 16 that transfers catalyst from regenerator 12 at a rate regulated by slide valve 10. A fluidization medium from nozzle 8 transports catalyst upwardly through a lower portion of a riser 14 at a relatively high density until a plurality of feed injection nozzles 18 (only one is shown) inject feed across the flowing stream of catalyst particles. The resulting mixture continues upwardly through an upper portion of riser 14 to a riser termination device. This specific device utilizes at least two disengaging arms 20 tangentially discharge the mixture of gas and catalyst through openings 22 from a top of riser 14 into disengaging vessel 24 that effects separation of gases from the catalyst. Most of the catalyst discharged from openings 22 fall downwardly in the disengaging vessel 24 into bed 44. Transport conduit 26 carries the separated hydrocarbon vapors with entrained catalyst to one or more cyclones 28 in reator or separator vessel 30. Cyclones 28 separate spent catalyst from the hydrocarbon vapor stream. Collection chamber 31 gathers the separated hydrocarbon vapor streams from the cyclones for passage to outlet nozzle 32 and into a downstream fractionation zone (not shown). Diplegs 34 discharge catalyst from the cyclones 28 into bed 29 in a lower portion of disengaging vessel 30 which pass through ports 36 into bed 44 in disengaging vessel 24. Catalyst and adsorbed or entrained hydrocarbons pass from disengaging vessel 24 into stripping section 38. Catalyst from openings 22 separated in disengaging vessel 24 passes directly into stripping section 38. Hence, entrances to the stripping section 38 include openings 22 and ports 36. Stripping gas such as steam enters a lower portion of the stripping section 38 through distributor 40 and rises counter-current to a downward flow of catalyst through the stripping section 38, thereby removing adsorbed and entrained hydrocarbons from the catalyst which flow upwardly through and are ultimately recovered with the steam by the cyclones 28. Distributor 40 distributes the stripping gas around the circumference of stripping section 38. In order to facilitate hydrocarbon removal, structured packing may be provided in stripping section 38. The spent catalyst leaves stripping section 38 through port 48 to reactor conduit 46 and passes into regenerator 12. The catalyst is regenerated in regenerator 12 as is known in the art and sent back to riser 14 through standpipe 16.

In cracking carbo-metallic feedstocks in accordance with FCC processes, the regeneration gas may be any gas which can provide oxygen to convert carbon to carbon oxides. Air is highly suitable for this purpose in view of its ready availability. The amount of air required per pound of coke for combustion depends upon the desired carbon dioxide to carbon monoxide ratio in the effluent gases and upon the amount of other combustible materials present in the coke, such as hydrogen, sulfur, nitrogen and other elements capable of forming gaseous oxides at regenerator conditions.

The regenerator is operated at temperatures in the range of about 1000.degree to 1600.degree. F., preferably 1275.degree. to 1450.degree. F., to achieve adequate combustion while keeping catalyst temperature below those at which significant catalyst degradation can occur. In order to control these temperatures, it is necessary to control the rate of burning which in turn can be controlled at lest in part by the relative amounts of oxidizing gas and carbon introduced into the regeneration zone per unit time.

The catalyst of this invention, with or without the metal additive is charged to a FCCU unit of the type outlined in FIG. 1 or to a Reduced Crude Conversion (RCC) unit. Catalyst particle circulation and operating parameters are brought up to process conditions by methods well-known to those skilled in the art. The equilibrium catalyst at a temperature of 1100.degree.-1500.degree. F. contacts the oil feed at riser wye 17. The feed can contain steam, water, naphtha and/or flue gas and can be injected at point 8 or 18. The catalyst and vaporous hydrocarbons travel up riser 14 at a contact time of 0.1-5 seconds, preferably 0.5-3 seconds. The catalyst and vaporous hydrocarbons are separated in riser termination device outlet 26 at a final reaction temperature of 900.degree.-1100.degree. F. The vaporous hydrocarbons are transferred to cyclones 28 where any entrained catalyst fines are separated and the hydrocarbon vapors are sent to a fractionator (not shown) via transfer line 32. The coked catalyst then is transferred to stripper 38 for removal of entrained hydrocarbon vapors and then to regenerator vessel 12 to form a dense fluidized bed 13. An oxygen containing gas such as air is admitted to the bottom of dense bed 13 in vessel 12 to combust the coke to carbon oxides. The resulting flue gas is processed through cyclones 11 and exits from the regenerator vessel 12 via line 23. The regenerated catalyst is transferred to stripper 60 to remove any entrained combustion gases and then transferred to riser 14 via line 16 to repeat the cycle.

At such time that containment metals on the catalyst becomes intolerable high such that catalyst activity and selectivity declines, additional catalyst and additive can be added and deactivated catalyst withdrawn at addition-withdrawal point 9 into the dense bed 13 of regenerator 12 and/or or at addition-withdrawal point 7 into regenerated catalyst standpipe 16. Addition-withdrawal points 7 and 9 can be utilized to add virgin catalysts containing one or more metal additives of the invention.

The additive generally contains 5 to 30 wt. % of a Group VIB metal, oxide and 2 to 10 wt. % of a Group VIII metal oxide and alumina. In the following Examples, the additive contained 5 to 20 wt. % of molybdenum and 2 to 5 wt. % of cobalt.

EXAMPLE

To demonstrate this invention, a ground Cobalt oxide-Moly oxide hydrotreating, catalyst was introduced to the laboratory FCC catalyst evaluation testing unit as an additive. The protocol used to evaluate this invention is identical to the protocol and conditions used to evaluate commercially available gasoline sulfur reducing catalysts. The additive was combined with a conventional zeolite catalyst. The following summarizes the test data and results at constant conversion weight percent and shows:

1) A significant improvement in gasoline sulfur reduction.
2) A significant reduction in diesel blendstock component sulfur cont.
3) A significant reduction in thiophenic, benzothiophenic and de-benzothiophenic compounds.
4) A significant increase in propylene.
5) A significant increase in iso-butylenes.
6) A significant increase in total pentenes with a corresponding increase in amylenes and iso-amylenes.
7) A significant reduction in ethane, propane and butane.
8) A significant reduction of organic sulfur compounds in the Liquefied Petroleum Gas (LPG).
9) An increase in FCC gasoline (R+M)/2) octane.
10) A decrease in H2S.
11) A decrease in flue gas NOx.

Figure 2:
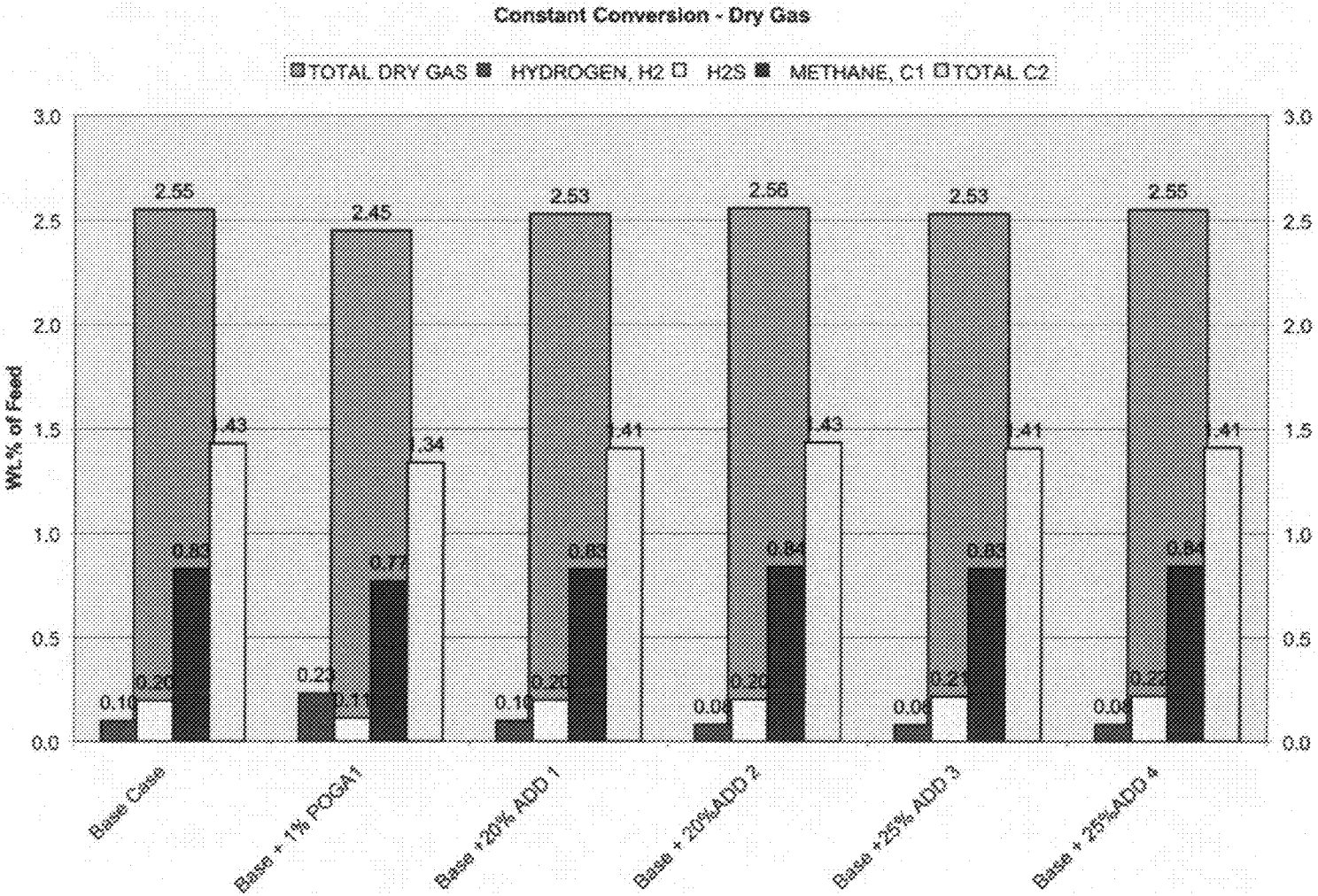
FIG. 2 is a chart showing a significant improvement in dry gas conversion according to this invention.

FIG. 2 is a chart showing a significant improvement in dry gas conversion according to this invention.

Figure 3:
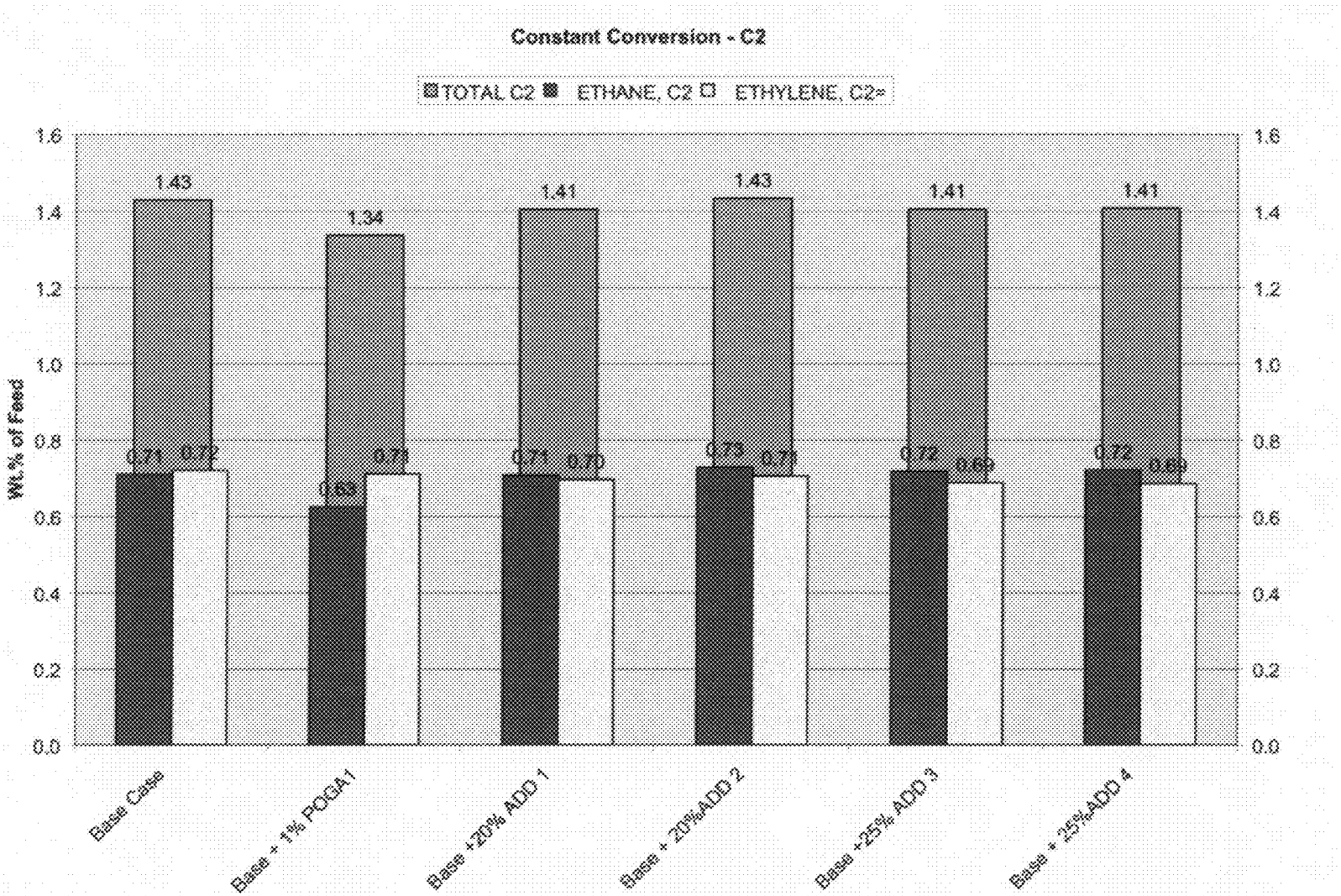
FIG. 3 is a chart showing a significant improvement in C2 conversion according to this invention.

FIG. 3 is a chart showing a significant improvement in C2 conversion according to this invention.

Figure 4:
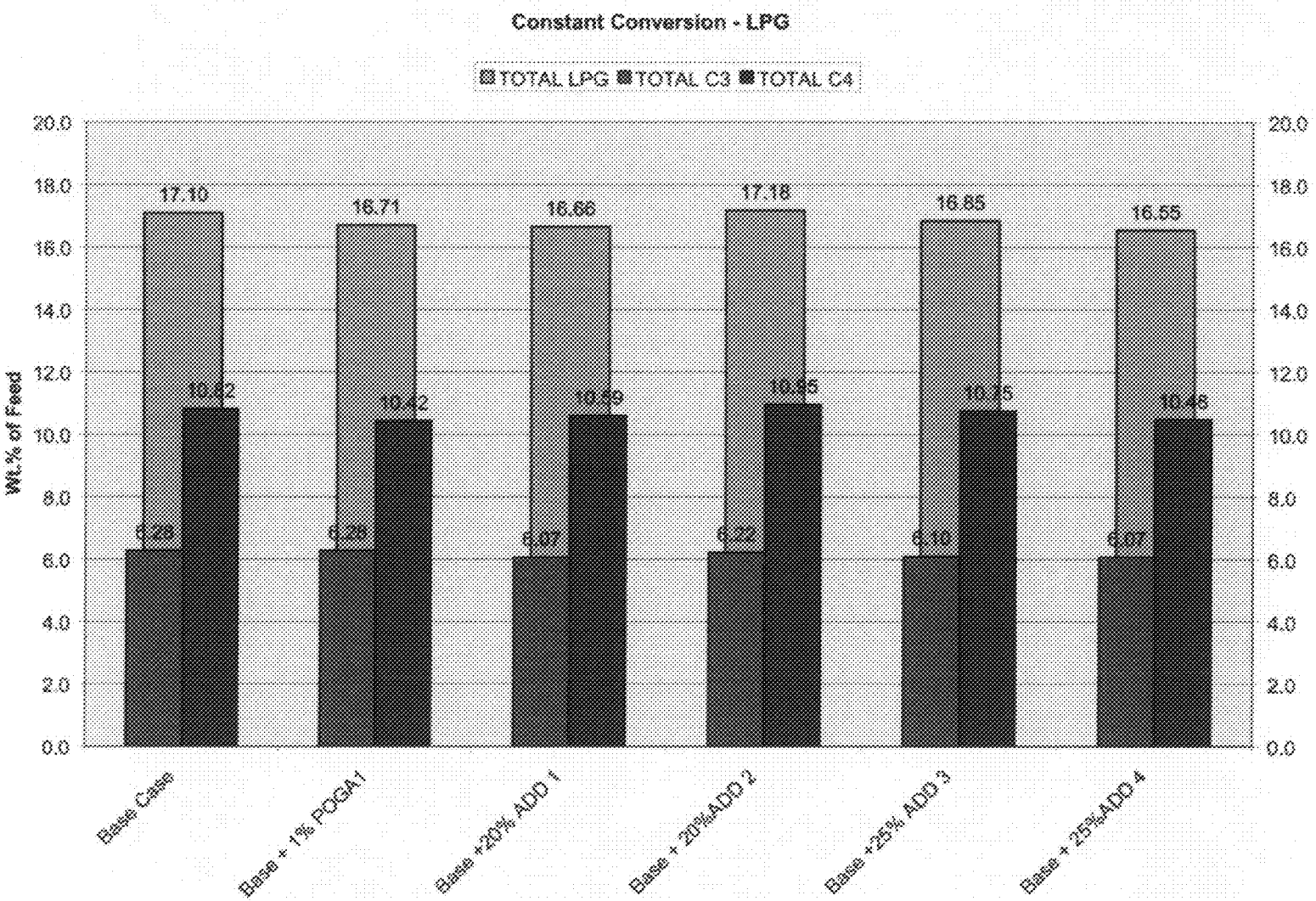
FIG. 4 is a chart showing a significant improvement in LPG conversion according to this invention.

FIG. 4 is a chart showing a significant improvement in LPG conversion according to this invention.

Figure 5:
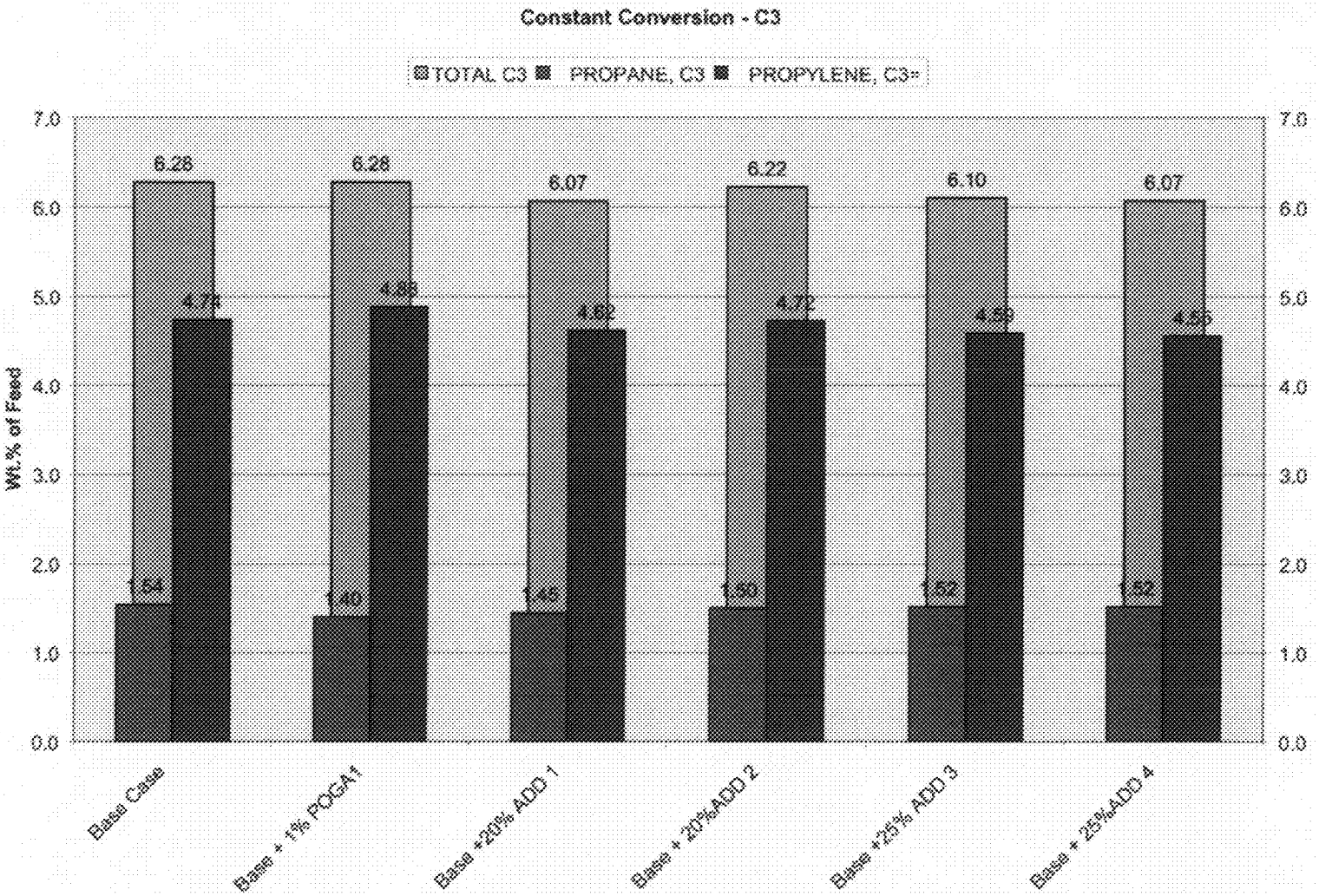
FIG. 5 is a chart showing a significant improvement in C3 conversion according to this invention.

FIG. 5 is a chart showing a significant improvement in C3 conversion according to this invention.

Figure 6:
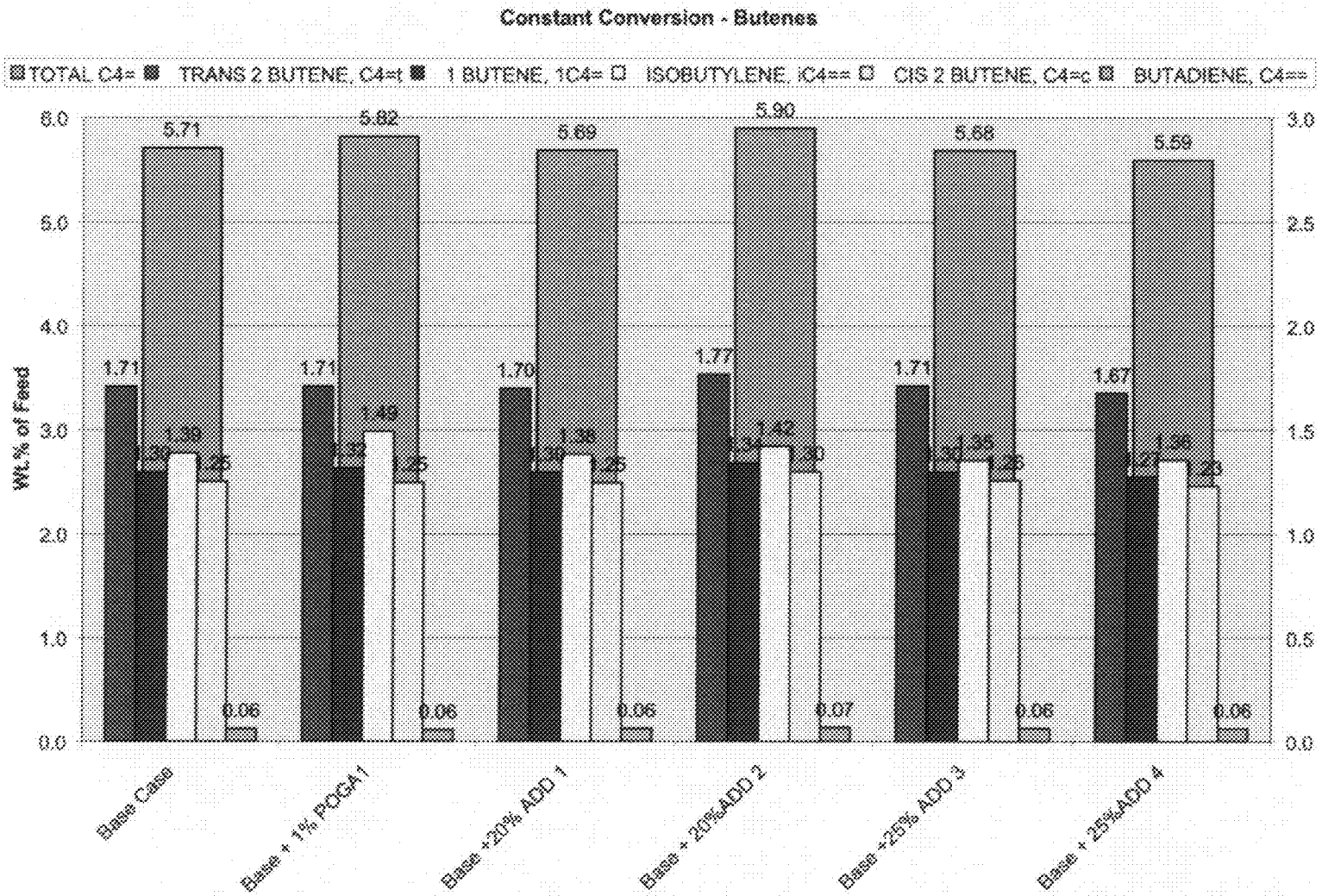
FIG. 6 is a chart showing a significant improvement in butane conversion according to this invention.

FIG. 6 is a chart showing a significant improvement in butane conversion according to this invention.

Figure 7:
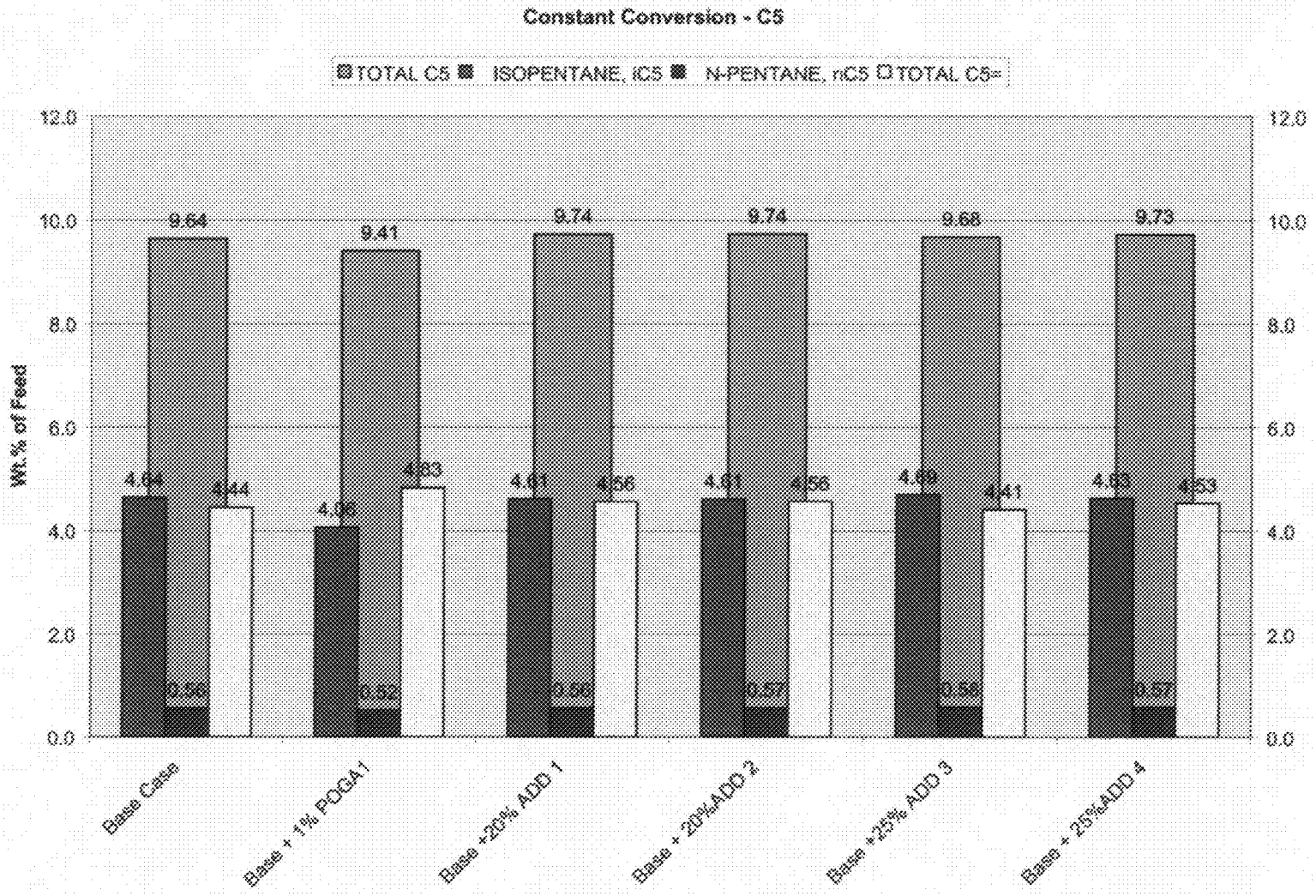
FIG. 7 is a chart showing a significant improvement in pentane conversion according to this invention.

FIG. 7 is a chart showing a significant improvement in pentane conversion according to this invention.

Figure 8:
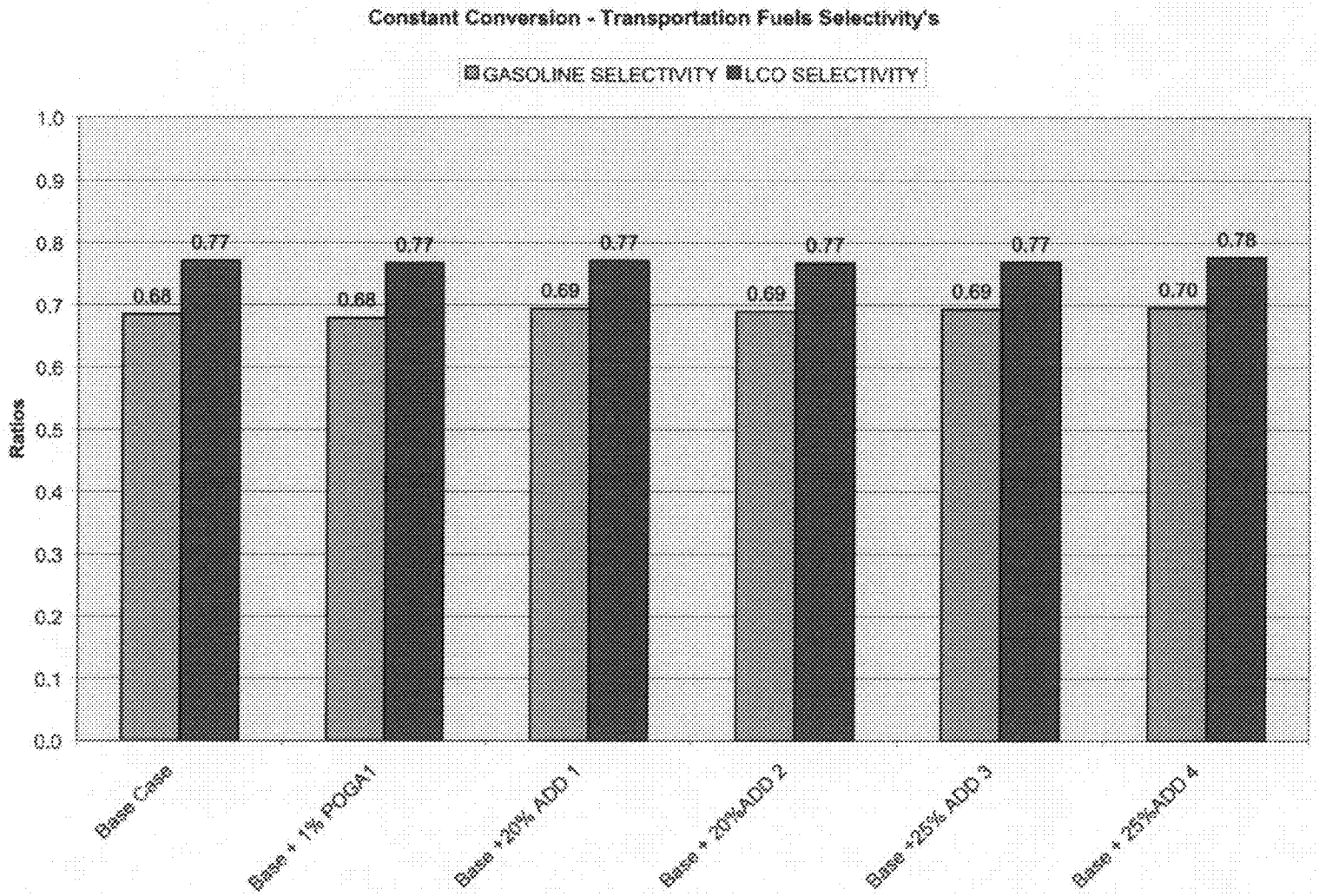
FIG. 8 is a chart showing a significant improvement in transportation fuel selectivity according to this invention.

FIG. 8 is a chart showing a significant improvement in transportation fuel selectivity according to this invention.

Figure 9:
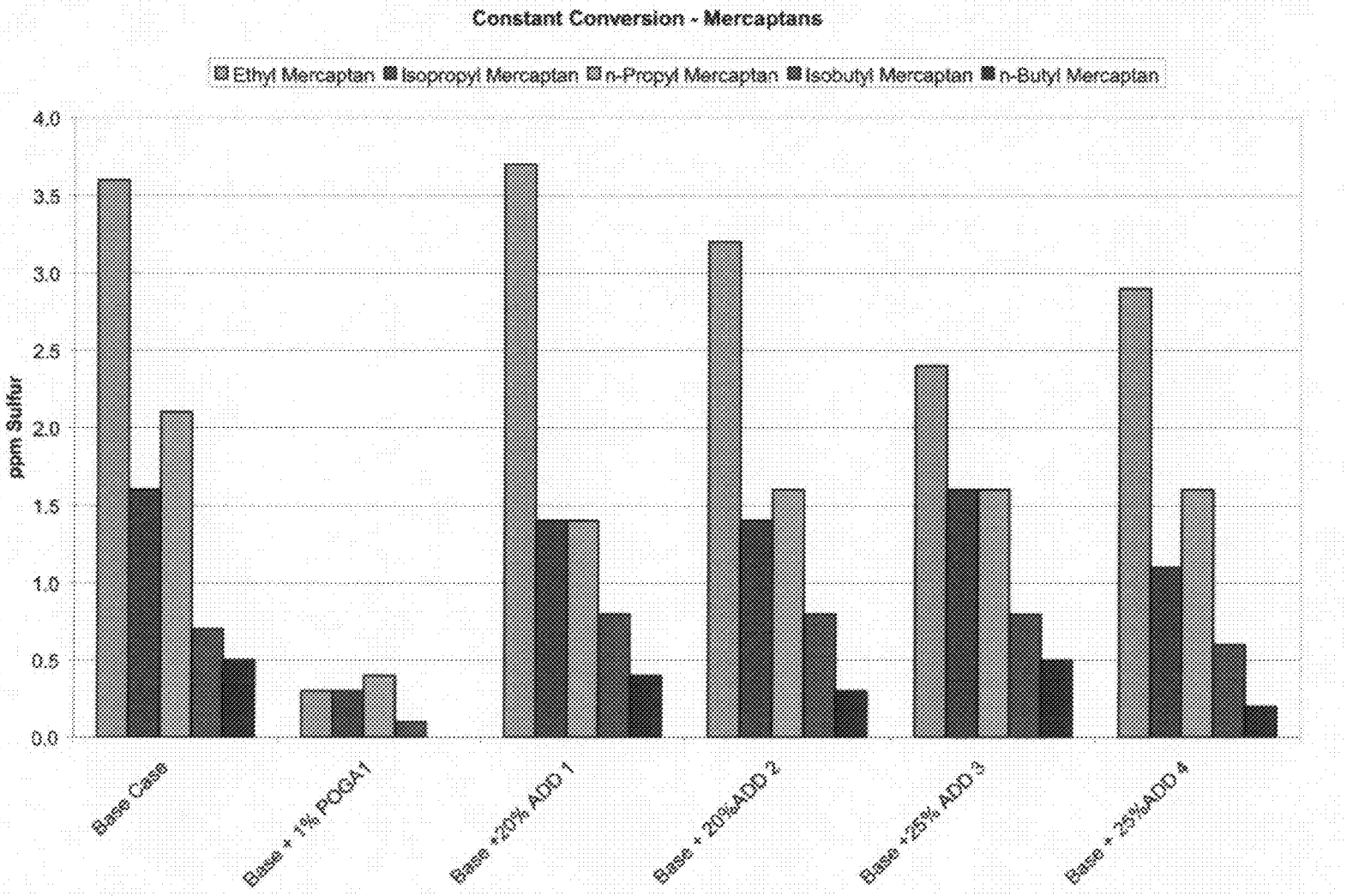
FIG. 9 is a chart showing a significant improvement in mercaptan reduction according to this invention.

FIG. 9 is a chart showing a significant improvement in mercaptan reduction according to this invention.

Figure 10:
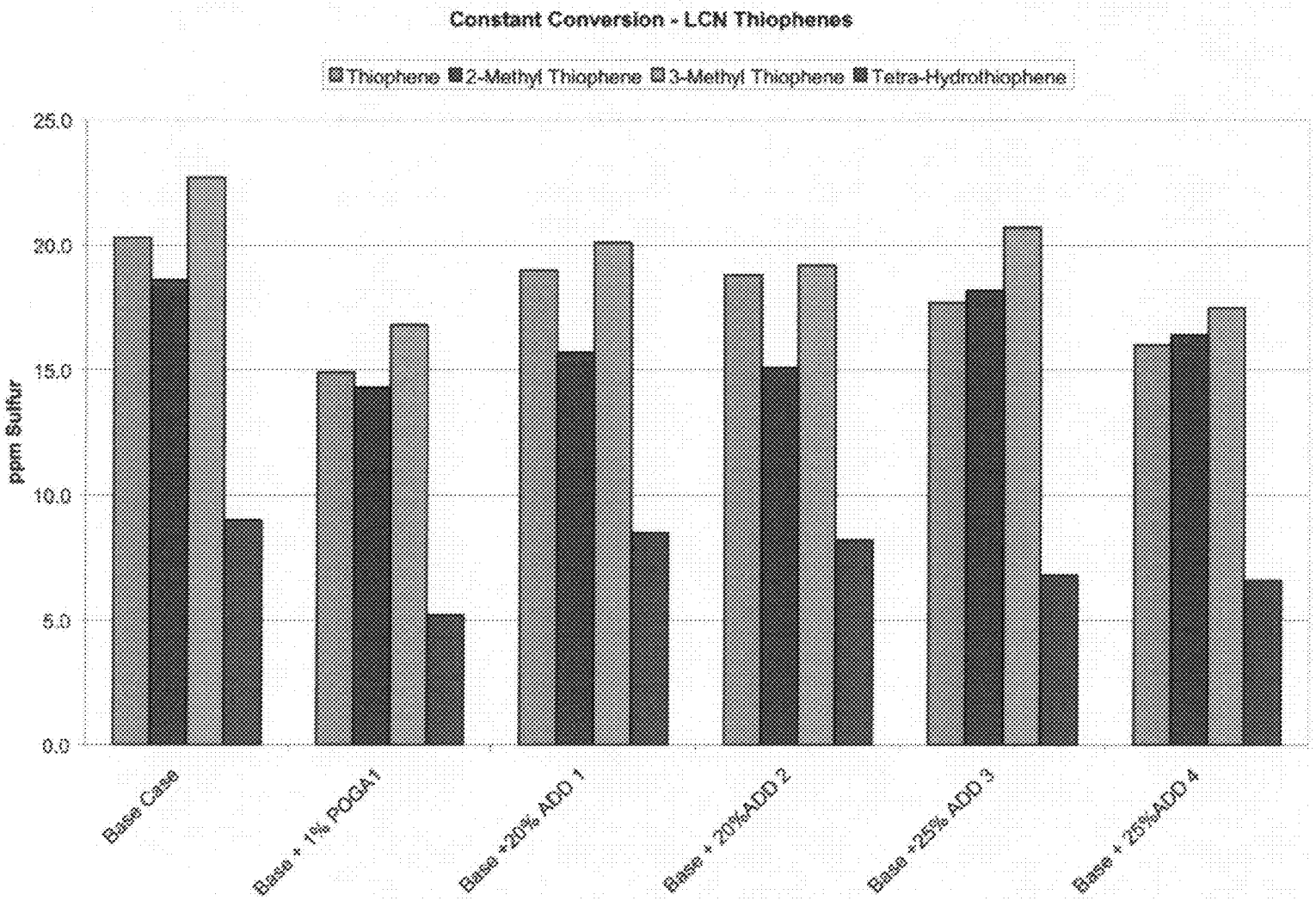
FIG. 10 is a chart showing a significant improvement in LCN thiophene conversion according to this invention.

FIG. 10 is a chart showing a significant improvement in LCN thiophene conversion according to this invention.

Figure 11:
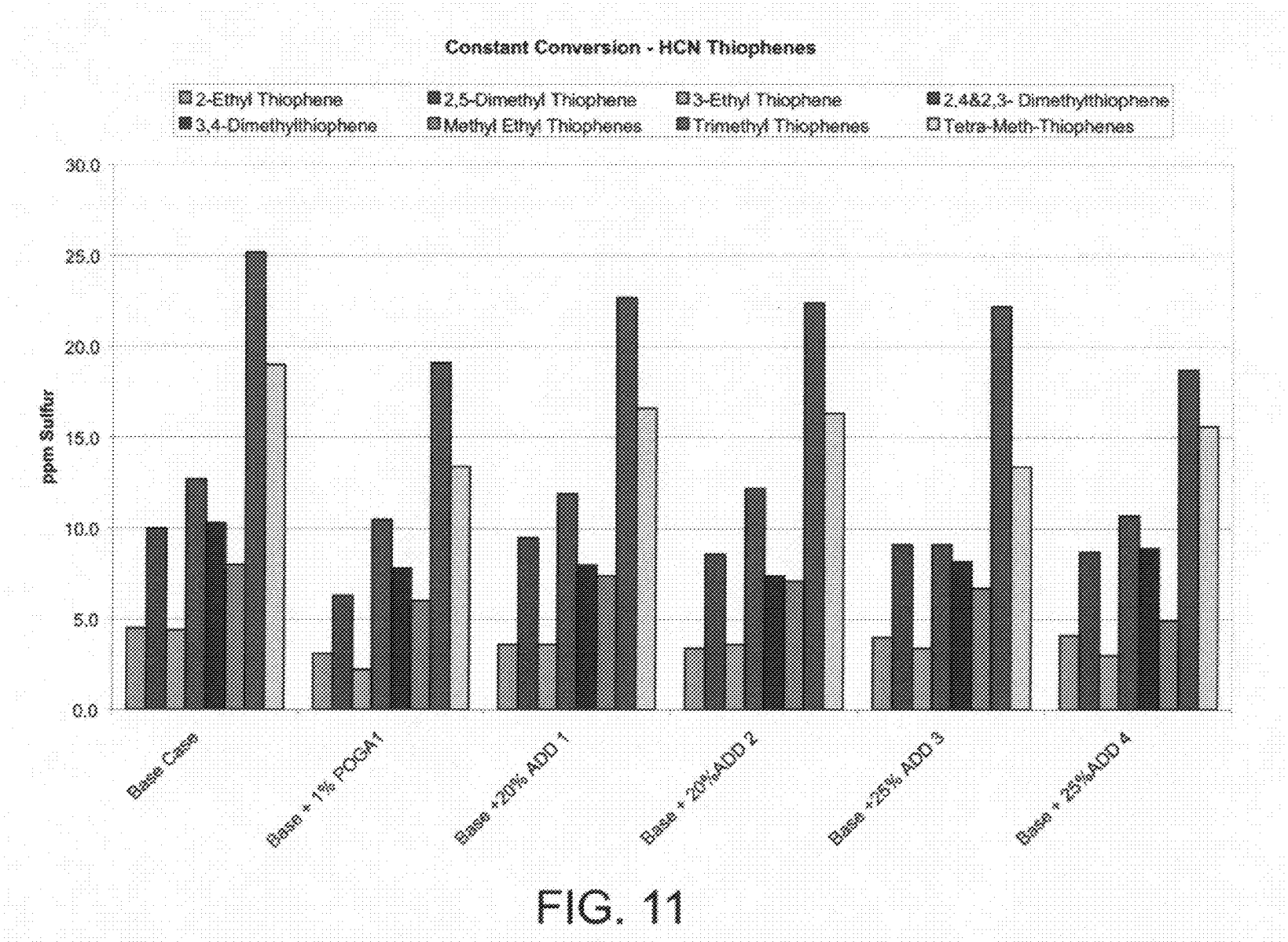
FIG. 11 is a chart showing a significant improvement in HCN thiophene conversion according to this invention.

FIG. 11 is a chart showing a significant improvement in HCN thiophene conversion according to this invention.

Figure 12:
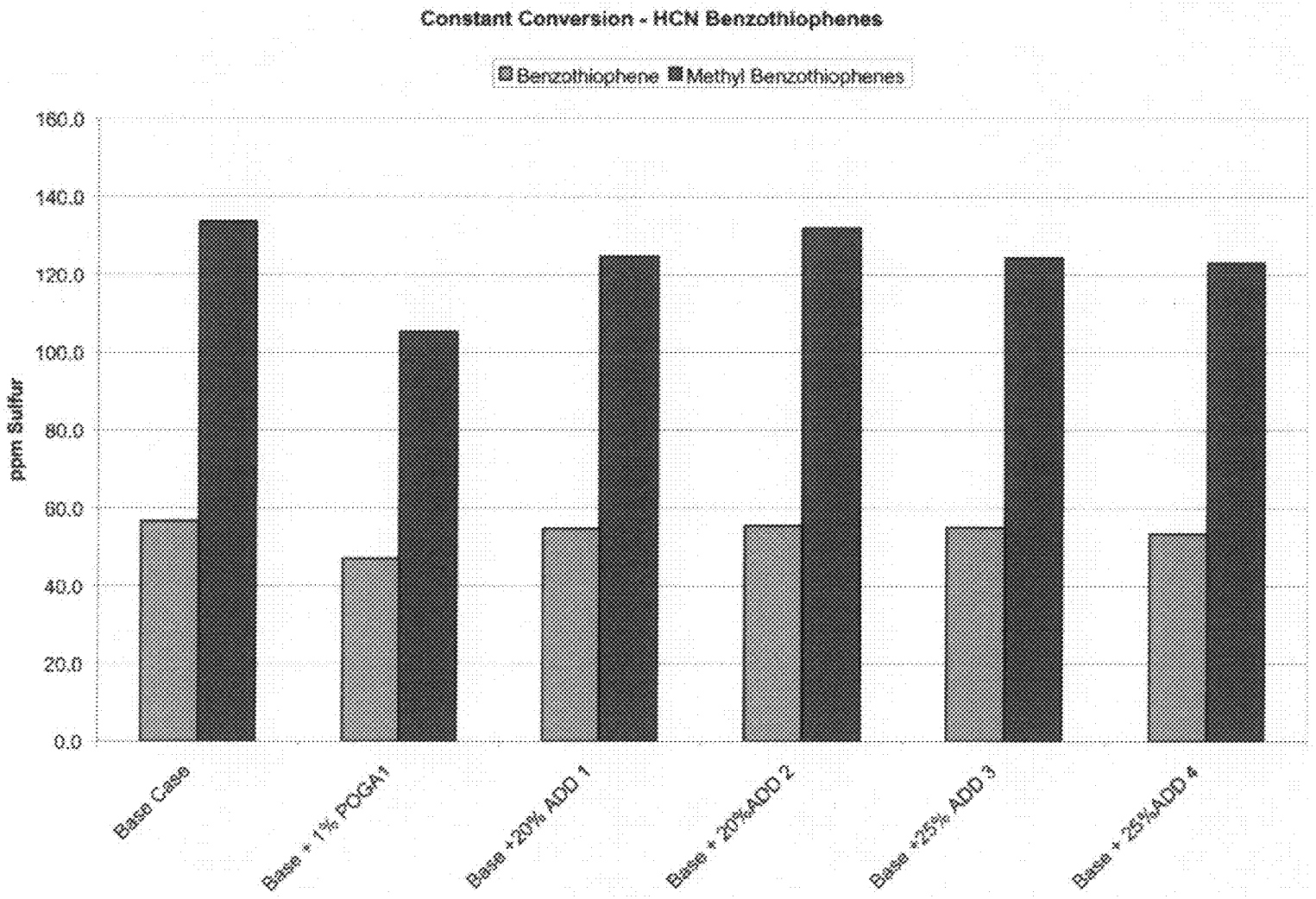
FIG. 12 is a chart showing a significant improvement in HCN benzothiophene conversion according to this invention.

FIG. 12 is a chart showing a significant improvement in HCN benzothiophene conversion according to this invention.

Figure 13:
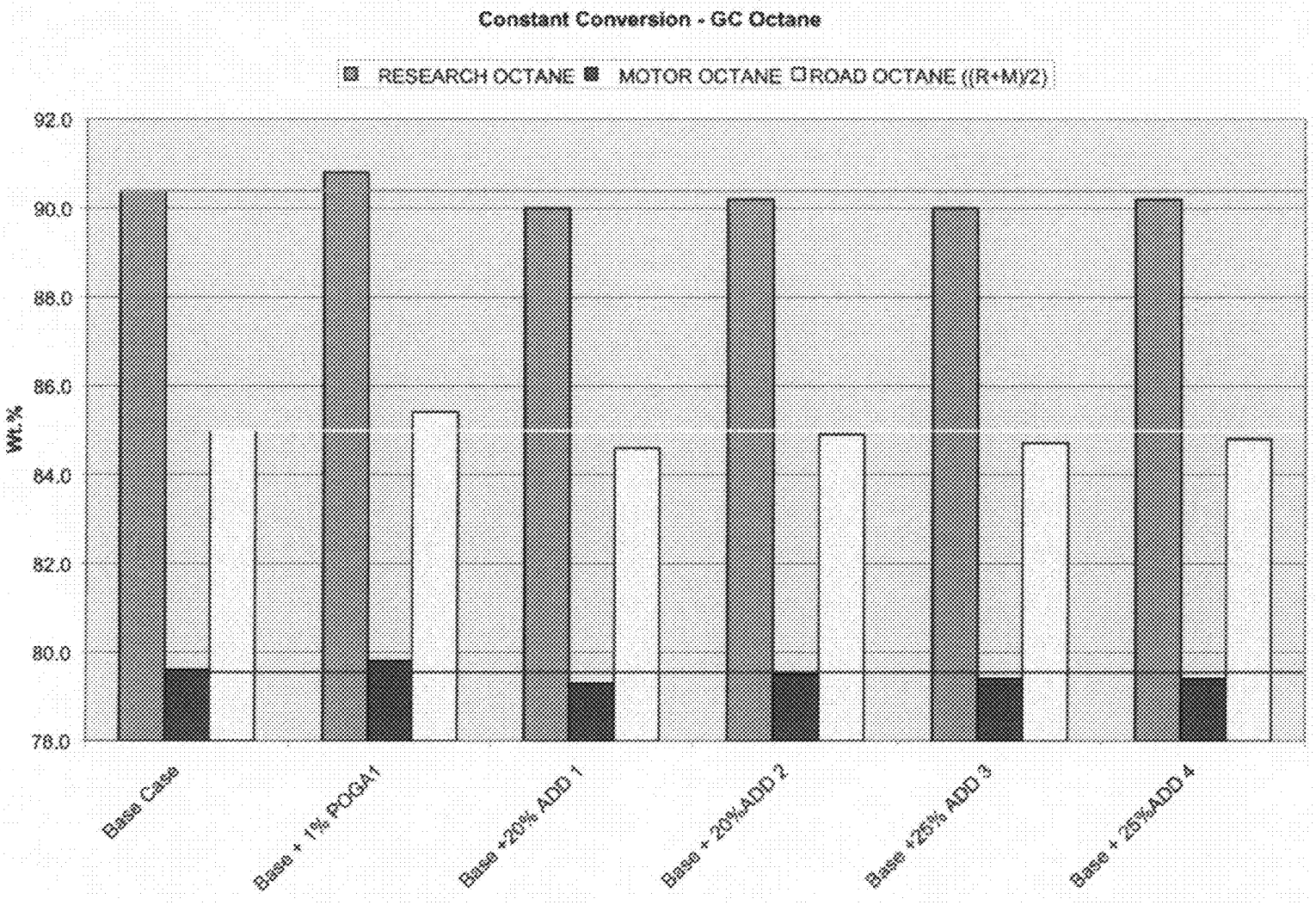
FIG. 13 is a chart showing a significant improvement in gasoline octane according to this invention.

FIG. 13 is a chart showing a significant improvement in octane according to this invention.

Figure 14:
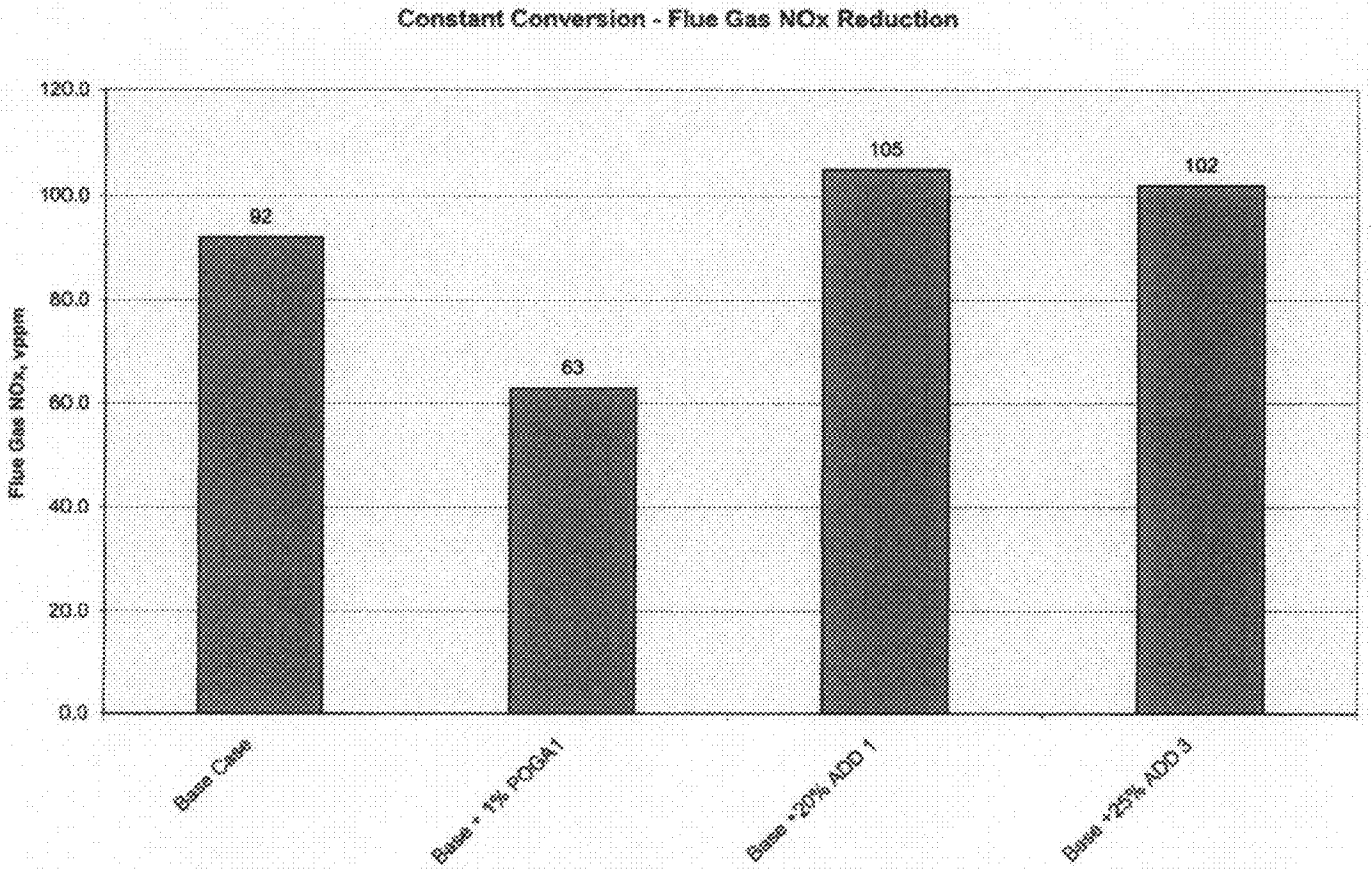
FIG. 14 is a chart showing a significant reduction in H2S and shift in sulfur distribution according to this invention.

FIG. 14 is a chart showing a significant reduction in H2S and shift in sulfur distribution according to this invention.

Figure 15:
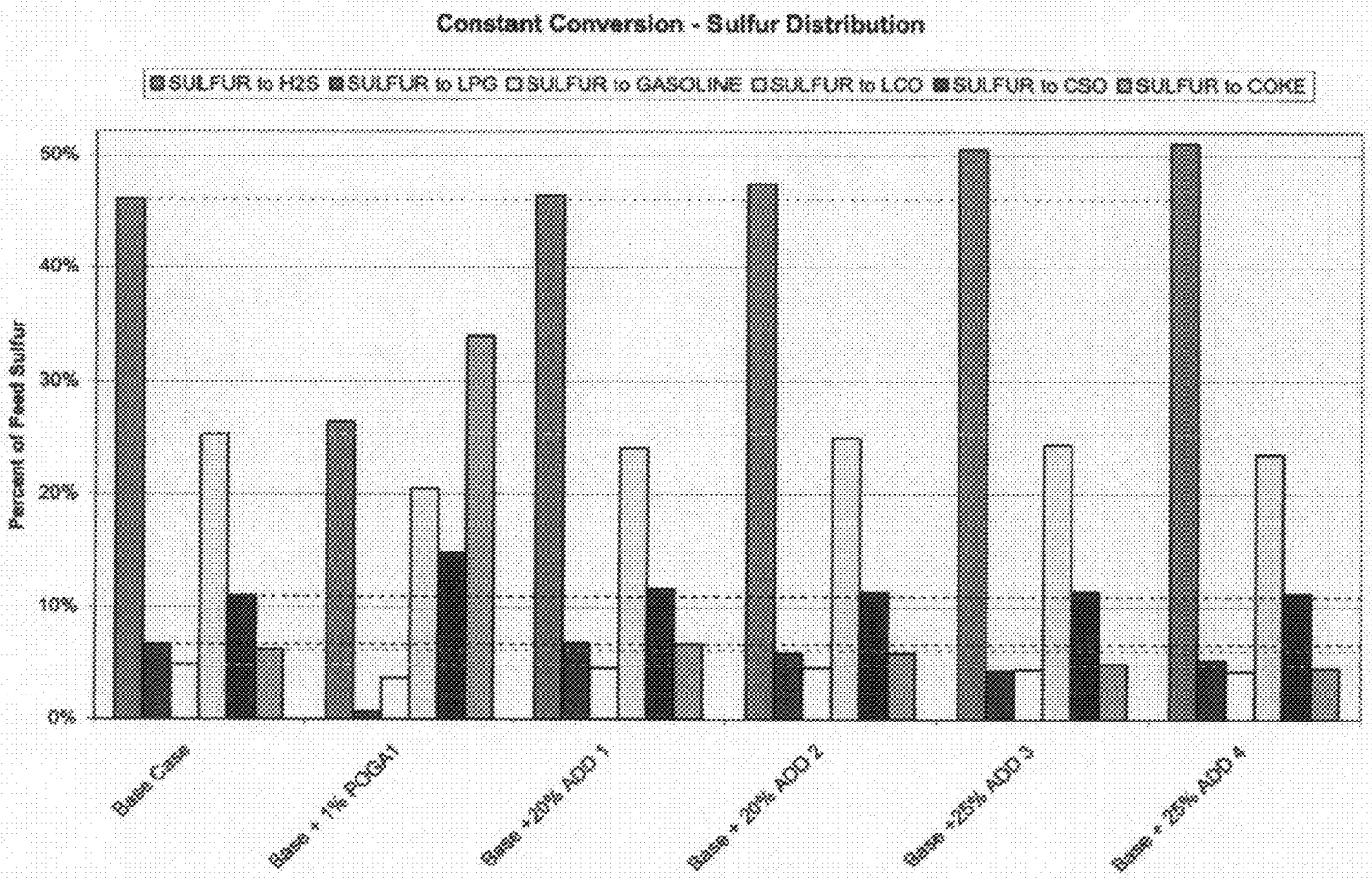
FIG. 15 is a chart showing a significant reduction in NOx according to this invention.

FIG. 15 is a chart showing a significant reduction in NOx according to this invention.

In the above protocols, the additive is typically used in an amount from about 0.1 to about 10 weight percent of the inventory in the FCCU. Preferably, the amount will be from about 0.5 to about 5 weight percent. About 2 weight percent represents a norm for most practical purposes. The additive may be added in the conventional manner, with make-up to the regenerator or by any other convenient method. The additive remains active for sulfur removal for extended periods of time although very high sulfur feeds may result in loss of sulfur removal activity in shorter times.

The effect of the present additives is to reduce the sulfur content of liquid cracking products, especially the light and heavy gasoline fractions, although reductions are also noted in the light cycle oil, making them more suitable for use as a diesel or home heating oil blend component. The significant reduction in H2S will also have a benefit on downstream processing units where H2S is removed via caustic and amine treatment. The lower H2S load on these units will improve unit efficiency and debottleneck capacity. The sulfur removed in the FCC is absorbed as a metal sulfide and released as Sox in the regenerator.

The ability of the additives of the invention to convert $NO_x$ in a FCCU regenerator operated in a partial or complete burn mode also may be determined. The key performance measurement in this test is the $NO_x$ conversion. It is desirable to have high $NO_x$ conversion for a wide range of $O_2$ and CO amounts. The activity of the compositions for converting $NO_x$ to nitrogen under various $O_2$ levels, in the reducing/oxidizing conditions possible in a regenerator operating in partial or complete burn are possible due to the oxygen storage capability of the additive. No other nitrogen oxides like $N_2O$ or $NO_2$ were detected.

MODIFICATIONS

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A process of reducing the sulfur content of a catalytically cracked petroleum fraction, which comprises catalytically cracking a petroleum feed fraction containing organosulfur compounds at elevated temperature in the presence of a cracking catalyst and an additive to produce cracking products of reduced sulfur content, wherein the additive comprises a mixture of particulate of 5 to 30 wt. % of a Group VIB metal oxide and 2 to 10 wt. % of a Group VIII metal oxide;

wherein the mixture of particulate is pulverized particulate having a particle size ranging from 1 nm to 900 nm; and wherein the cracking catalyst has a weight and the additive is present in an amount ranging from 1 to 25 weight percent of the weight of the cracking catalyst.

2. A process according to claim 1 further comprising the step of impregnating the cracking catalyst with the additive prior to catalytically cracking the petroleum feed fraction.

3. A process according to claim 1 further comprising the step of injecting of the additive as a liquid naphthenate or other derivative with the petroleum feed fraction so it will crack on the circulating catalyst.

4. A process according to claim 1 wherein the Group VIB metal oxide is molybdenum oxide and the Group VIII metal oxide cobalt oxide.

5. A processing according to claim 1 wherein the additive contains 5 to 20 wt. % of the Group VIB metal oxide and 2 to 5 wt. % of the Group VIII metal oxide.

6. A process according to claim 1 wherein the cracking catalyst comprises faujasite.

7. A process according to claim 1 wherein the cracking catalyst comprises zeolite.

8. A process according to claim 1 including the step of reducing emitted $NO_x$.

9. A process according to claim 1 including the step of minimizing sulfur formation in a FCCU riser.

10. A process according to claim 1 including the step of converting $H_2S$ from cracked organosulfur compounds to the metal sulfides in a presence of the additive.

11. A process according to claim 1 including the step of minimizing the availability of H2S to combine with olefinic compounds from the catalytic cracking.

12. A process according to claim 1 including the step of reducing slurry oil refractory sulfur via the cracking.

13. A process according to claim 1 including the step of reducing H2S via the cracking to reduce load on downstream processing units to debottleneck.

14. A process according to claim 1 wherein lighter cracked sulfur compounds formed in the cracking are cracked upwards into gasoline, diesel blendstock or LPC range products.

15. A process according to claim 1 wherein the liquid cracking products are gasoline or a diesel blendstock.

16. A process according to claim 1 including a catalyst and additive support of a refractory inorganic oxide or activated carbon.

17. A process according to claim 16 wherein the support comprises a refractory inorganic oxide selected from the group consisting of alumina, silica, titania, clay and mixtures thereof.

18. A process according to claim 16 wherein the refractory inorganic oxide is selected from the group consisting of alumina, silica, clay and mixtures thereof.

19. A process according to claim 16 wherein the refractory inorganic oxide is alumina.

20. A process according to claim 1 further comprising the step of recovering the cracking catalyst from the cracking step and treating the catalyst in a regeneration zone to regenerate the catalyst.

21. A process according to claim 1 wherein the additive has a particle size ranging from 50 nm to 800 nm.

22. A process according to claim 1 wherein the additive has a particle size ranging from 100 nm to 700 nm.

* * * * *